US006290561B1

(12) United States Patent
Garofalo et al.

(10) Patent No.: US 6,290,561 B1
(45) Date of Patent: Sep. 18, 2001

(54) SWIMMING FLIPPER

(75) Inventors: Giovanni Garofalo, Rapallo; Mario Viale, Chiavari, both of (IT)

(73) Assignee: HTM Sport S.P.A. (IT)

( * ) Notice: Subject to any disclaimer, the term of this patent is extended or adjusted under 35 U.S.C. 154(b) by 0 days.

(21) Appl. No.: 09/790,707

(22) Filed: Feb. 23, 2001

(30) Foreign Application Priority Data

Feb. 25, 2000 (IT) ..... GE2000A25

(51) Int. Cl.[7] ..... A63B 31/08
(52) U.S. Cl. ..... 441/64
(58) Field of Search ..... 441/61–64; D21/806

(56) References Cited

U.S. PATENT DOCUMENTS 3,171,142 3/1965 Auzols .
3,256,540 6/1966 Novell .
3,665,535 * 5/1972 Picken ..... 441/64
4,007,506 2/1977 Rasmussen .
4,209,866 * 7/1980 Loeffler ..... 441/64
4,887,985 12/1989 Garofalo .

FOREIGN PATENT DOCUMENTS 1 075 997 2/1960 (DE) .
0 884 073 12/1998 (EP) .
0 998 962 5/2000 (EP) .

* cited by examiner

*Primary Examiner*—Ed Swinehart
(74) *Attorney, Agent, or Firm*—Larson & Taylor, PLC

(57) ABSTRACT

Swimming flipper consisting of a footwear or shoe provided with a sole equipped on its front and sides with at least two protruding elements, and a blade connected to said sole; said flipper further comprising at least an extensible element substantially transversal to the blade, laterally connected to the protruding elements and centrally to the flipper surface in an area between said protruding elements.

11 Claims, 3 Drawing Sheets

SWIMMING FLIPPER

BACKGROUND AND SUMMARY OF THE INVENTION

The present invention relates to swimming flippers, and in particular to a flipper substantially consisting of a blade and a shoe or footwear suitably shaped and provided with a sole.

It is known that while swimming the scuba diver substantially makes with each flipper, synchronously and continuously, two kinds of movement or flipping: a movement down-up, i.e. the active flipping, and a movement up-down, i.e. the passive flipping. During the passive flipping the back of the blade acts onto the water mass below, whereas in the active flipping the lower surface of the blade acts onto the water mass in order to ensure the necessary forward thrust for the scuba diver. It is known about the existence of flippers provided with blades which can be rotated of a certain angle with respect to the sole, and which are connected to front protruding elements of said sole by means of side extensible elements, which, during the passive flipping, stretch out and allow to vary the inclination of the blade with respect to the shoe and to the sole under the action of the water acting onto the back of said blade, so as to ease the diver's movement. During the active flipping said extensible elements shrink back to the rest position and substantially allow the blade to line up with the sole surface, thus allowing the flipper to be in an optimal position and with a wide thrust surface on the water mass in touch with the lower surface of the blade. Such flippers, however, because of said blades rotating of a certain angle with respect to the shoe and its sole, require the mounting of side stroke ends used by the blade at the end of the active flipping, so as to avoid undesired rotations upwards. The mounting of said stroke ends makes the blade rather difficult to carry out, and the side extensible elements, besides being difficult to remove and replace, do not always allow a perfect elasticity and flexibility of the blade.

The present invention aims at carrying out a swimming flipper which overcomes the disadvantages of known flippers, which is easy to carry out and ensures a high efficiency during the diver's active and passive flipping.

Said aim is achieved by the present invention by means of a swimming flipper consisting of a footwear or shoe equipped with a sole provided on its front and lateral sides with at least two protruding elements, and a blade connected to said sole; said flipper consists of at least an extensible element substantially transversal with respect to the blade and laterally connected to said protruding elements and centrally to the flipper surface in an area between said protruding elements.

According to an aspect of the present invention, the extensible element consists of at least two lateral portions, whose ends are connected to the protruding elements, and of at least a central portion connected to the blade surface by means of suitable seats obtained on said surface. The lateral portions of said connecting rod can be regarded, during the active flipping, as abutting or limit elements of the stroke in the opposite direction for the upper surface of the blade, advantageously avoiding the mounting of stroke ends.

Moreover, according to another aspect of the present invention, it is possible, thanks to the mounting of the transversal extensible element, to carry out a flipper in which the blade is connected to the shoe sole by means allowing its removal, if necessary.

BRIEF DESCRIPTION OF THE DRAWINGS

Further aims and advantages of the present invention will be better understood during the following description, regarded as a mere non-limiting example and referring to the enclosed drawings, in which.

DESCRIPTION OF THE PREFERRED EMBODIMENT OF THE INVENTION

Figure 1:
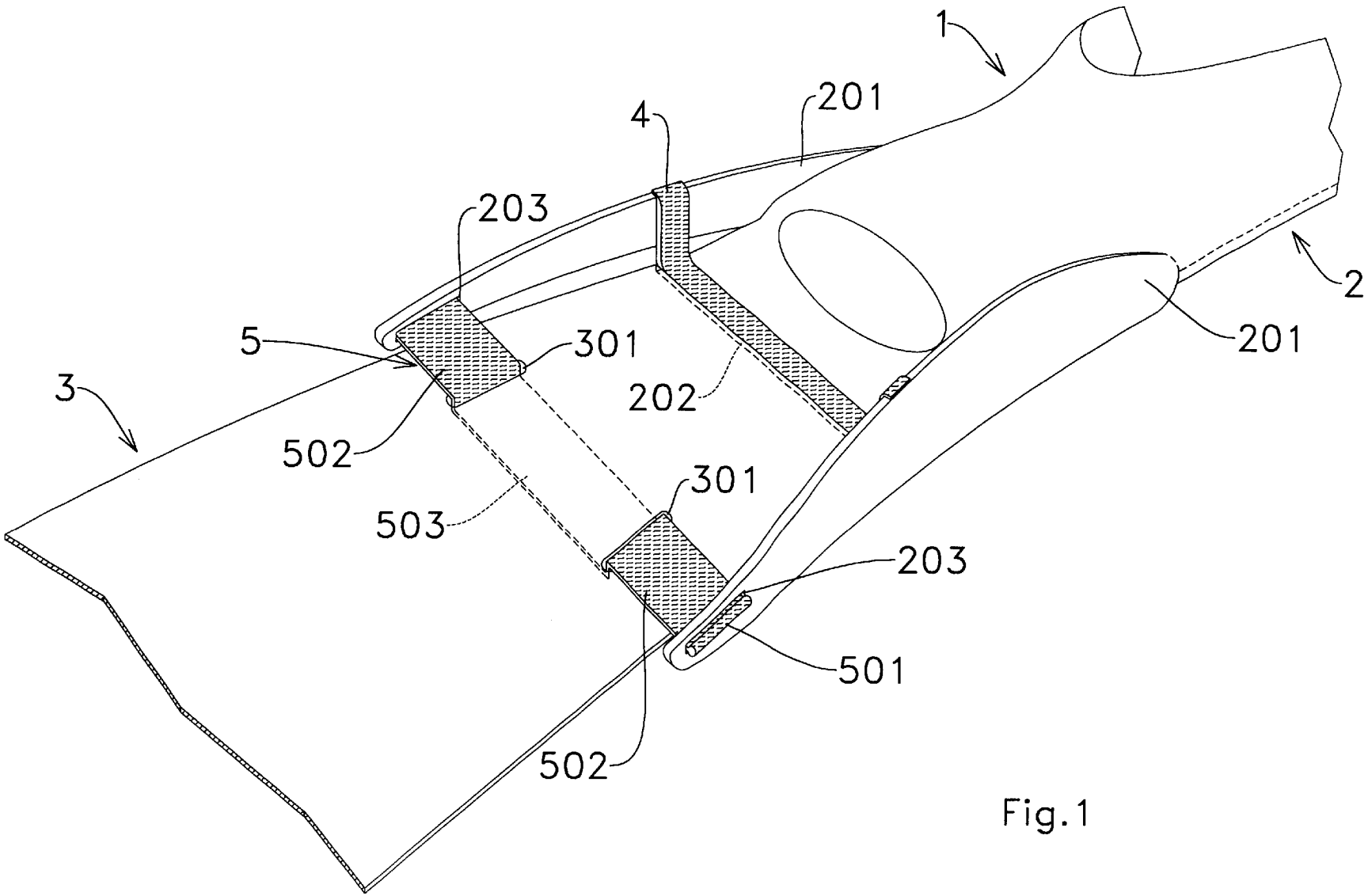
FIG. 1 shows a partial perspective view of a swimming flipper according to the present invention, in a position referring to the beginning or to the end of the active flipping.

With reference to FIG. 1, the latter shows a swimming flipper according to the present invention consisting of a footwear or shoe 1 made of a relatively soft material, for instance elastomeric material, attached to a sole 2 showing two protruding elements 201 placed in the front and on the sides. Said sole 2 and its protruding elements 201 are made of a relatively stiff material, for instance thermoplastic material. The flipper shows on its front side a blade 3, suitably shaped and connected to the sole 2 by means of a groove 202 with a smaller thickness with respect to the rest of said sole, so as to form a hinge around which said blade 3 can rotate. Said groove 202 is filled up with a layer of soft material, preferably elastomeric material, by means of a process of over-molding onto the protruding elements 201. Two slots 301 have been obtained on the surface of the blade 3, said slots being substantially transversally lined up with the ends of the protruding elements 201, into which a transversal extensible element 5 is introduced. Said extensible element 5 is made of elastomeric material and consists of two lateral portions 502 placed above the surface of the blade 2, a central portion 503 placed below the surface of said blade 3, and, on each end, a terminal portion 501 suitably shaped and with a greater thickness with respect to the rest of said element 5: said terminal portion 501 is fitted into a seat 203 obtained near the end of the correspondent protruding element 201. As an alternative to the fitting of the terminal portions 501 of the extensible element 5 into the seats 203, it could be provided for other mechanical fixing systems for the ends of said extensible element to the protruding elements, for instance screws, pins or others which, anyway, would allow its removal.

Figure 2:
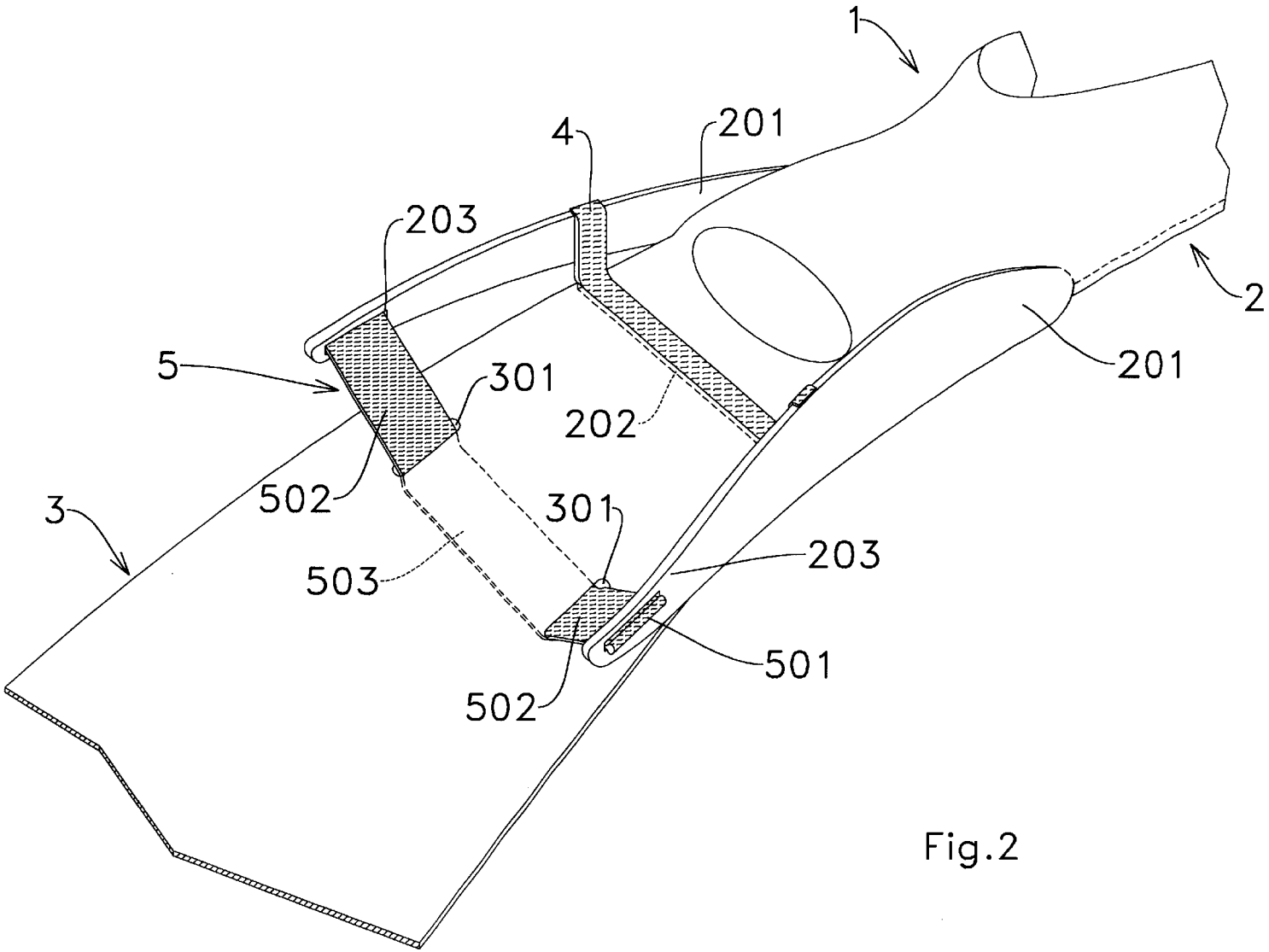
FIG. 2 shows a partial perspective view of the flipper in FIG. 1, in a position referring to the end of the passive flipping.

FIG. 1 shows the present flipper in a position in which the blade 3 is substantially lined up with the sole 2 of the shoe 1, that is to say, at the beginning or at the end of the active flipping, said position being ensured by the abutting of the peripheral portion of the upper surface of the blade 3 onto the lower surface of the lateral portions 502 of the extensible element 5. FIG. 2 shows the flipper in FIG. 1 in a position at the end of the passive flipping, with the lateral portions 502 of the element 5 in their maximum extension and the blade 3 inclined with respect to the sole 2. Said position can be reached by the rotation of the blade 3 around the hinge obtained by means of the groove 202 and allows the diver to complete easily the phase of passive flipping.

Figure 3:
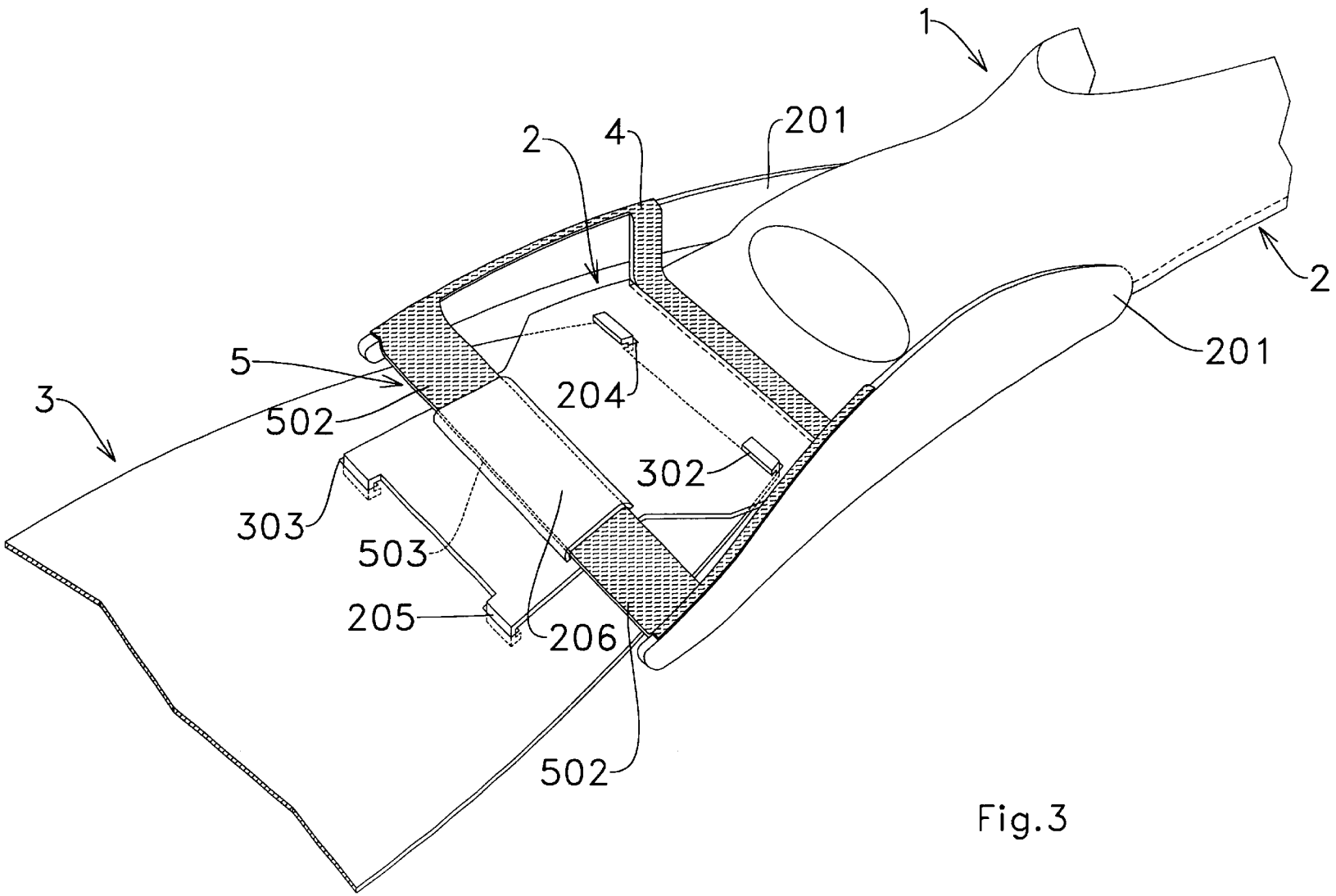
FIG. 3 shows a partial view of an execution variant of the present flipper equipped with an interchangeable blade.

FIG. 3 shows an execution variant of the present flipper, in which the blade 3 and the sole 2 can be separated. Said blade 3 is provided on its back rim with two protruding strips 302 suitably shaped, which are fitted into two seats 204 obtained on a sole 2 portion placed before the groove 202 filled up with the layer 4. Said sole 2 comprises in its turn, on its front rim, two protruding strips 205 suitably shaped, which are fitted, similarly to the strips 302 of the blade 3, into two seats 303 obtained on the surface of said blade 3.

As can be observed, therefore, the front portion of the sole 2 of the flipper overlaps the back portion of the blade 3 for a certain length. The extensible element 5 and the layer 4 are obtained, in the present execution variant, by over-molding elastomeric material onto the protruding elements 201 of the sole 2, as an alternative to the mechanical fixing described in FIGS. 1 and 2. The central portion 503 of the extensible element 5 passes through a slot 206 which can be obtained by a suitable shaping of the surface of the sole 2, or it can be later fixed onto the upper surface of said sole. The dynamics of movements during the active and passive flipping is wholly similar to the description referring to the previous figures, in particular in the position shown the upper surface of the blade 3 abuts, near the peripheral portion, onto the lower surface of the lateral portions 502 of the extensible element 5, thus avoiding and/or limiting the rotation upwards of the blade 3 and of the front portion of the sole 2 integral with it.

As shown by the previous description, therefore, the extensible element shows the additional advantage of carrying out a flipper equipped with a blade and a sole which can be separated, because there are non fixing means and moreover, by combining the forms of embodiment of the flipper in FIG. 1 and FIG. 3, said extensible element can be removed from the rest of the flipper together with the blade 3.

What is claimed is:

1. Swimming flipper comprising a shoe portion provided with a sole equipped on its front and sides with at least two protruding elements, a blade connected to said sole, and at least an extensible element substantially transversal to said blade, said extensible element being laterally connected to said protruding elements and being centrally connected to the blade in an area between said protruding elements.

2. Swimming flipper according to claim 1, wherein said extensible element comprises at least two lateral portions, whose ends are connected to said protruding elements, and at least a central portion connected to said blade by means of suitable seats formed on said blade.

3. Swimming flipper according to claim 2, wherein said seats comprises at least a pair of slots formed in said blade, said slots being crossed by the extensible element, in such a manner that its lateral portions overlap the surface of said blade.

4. Swimming flipper according to claim 1, wherein said extensible element presents on each end a terminal portion fitted into a seat formed onto the correspondent protruding element.

5. Swimming flipper according to claim 1, and including a groove between said blade and said sole;

said groove being filled up with at least a layer of elastomeric material.

6. Swimming flipper according to claim 1, wherein said extensible element is made of elastomeric material.

7. Swimming flipper according to claim 5, wherein said extensible element and said layer are laterally connected to said protruding elements of the sole by over-molding of the elastomeric material of said elements.

8. Swimming flipper according to claim 1, wherein said blade and said sole are connected by means allowing their separation.

9. Swimming flipper according to claim 8, wherein said blade and said sole are equipped, respectively on their back and front end, with one or more protruding strips fitted into suitable seats, respectively obtained on the surface of said sole and of said blade.

10. Swimming flipper according to claim 8, wherein the front portion of said sole partially overlap the back portion of said blade, and the said transversal extensible element is connected to said front portion of said sole.

11. Swimming flipper according to claim 10, wherein said connecting means comprises of a slot, protruding above the surface of said sole, said slot being crossed by said extensible element.

* * * * *